US006152695A

United States Patent [19]

Fukue et al.

[11] Patent Number: 6,152,695

[45] Date of Patent: Nov. 28, 2000

[54] GAS TURBINE MOVING BLADE

[75] Inventors: Ichiro Fukue; Eiji Akita; Kiyoshi Suenaga; Yasuoki Tomita, all of Takasago, Japan

[73] Assignee: Mitsubishi Heavy Industries, Ltd., Tokyo, Japan

[21] Appl. No.: 09/243,821

[22] Filed: Feb. 3, 1999

[30] Foreign Application Priority Data

| | | | |
|---|---|---|---|
| Feb. 4, 1998 | [JP] | Japan | 10-023305 |
| Feb. 4, 1998 | [JP] | Japan | 10-023306 |
| Feb. 4, 1998 | [JP] | Japan | 10-023307 |
| Feb. 16, 1998 | [JP] | Japan | 10-032874 |
| Feb. 16, 1998 | [JP] | Japan | 10-032875 |

[51] Int. Cl.[7] ..... F01D 5/18

[52] U.S. Cl. ..... 416/97 R; 416/191; 415/115

[58] Field of Search ..... 415/115; 416/96 A, 416/96 R, 97 A, 97 R, 189, 191, 192

[56] References Cited

U.S. PATENT DOCUMENTS

| | | | |
|---|---|---|---|
| 3,389,889 | 6/1968 | Penny . | |
| 3,527,544 | 9/1970 | Allen . | |
| 3,606,574 | 9/1971 | Brands et al. . | |
| 3,819,295 | 6/1974 | Hauser et al. . | |
| 4,127,358 | 11/1978 | Parkes . | |
| 4,940,388 | 7/1990 | Lilleker et al. . | |
| 4,946,346 | 8/1990 | Ito . | |
| 4,948,338 | 8/1990 | Wickerson . | |
| 5,460,486 | 10/1995 | Evans et al. . | |
| 5,482,435 | 1/1996 | Dorris et al. . | |
| 5,609,466 | 3/1997 | North et al. . | |
| 5,779,447 | 7/1998 | Tomita et al. | 416/97 R |
| 5,785,496 | 7/1998 | Tomita . | |

FOREIGN PATENT DOCUMENTS

| | | |
|---|---|---|
| 2275975 | 3/1973 | France . |
| 58-47104 | 3/1983 | Japan . |
| 2-221602 | 9/1990 | Japan . |
| 3-194101 | 8/1991 | Japan . |
| 8-200002 | 8/1996 | Japan . |
| 9-53407 | 2/1997 | Japan . |
| 10-212903 | 8/1998 | Japan . |
| 872705 | 7/1961 | United Kingdom . |
| 1276200 | 6/1972 | United Kingdom . |
| 2132703A | 7/1984 | United Kingdom . |
| 1605335 | 12/1991 | United Kingdom . |

OTHER PUBLICATIONS

Patent Abstracts of Japan, Publication No. 08200002, publication date Aug. 6, 1996.

Patent Abstracts of Japan, Publication No. 09053407, publication date Feb. 25, 1997.

English Language Abstract of Japanese Patent No. 09053407A, dated Feb. 25, 1997.

English Language Abstract of Japanese Patent No. 08200002A, dated Aug. 6, 1996.

English Language Abstract of Japanese Patent No. 10212903A, dated Aug. 11, 1998.

*Primary Examiner*—Edward K. Look
*Assistant Examiner*—Liam McDowell
*Attorney, Agent, or Firm*—Wenderoth, Lind & Ponack, L.L.P.

[57] ABSTRACT

In a gas turbine moving blade 1, the convection of cooling air is promoted to enhance the heat transfer rate, the cooling effect of a shroud 2 is enhanced and the entire cooling effect of the blade is enhanced. An inner cavity 10 is formed in the blade over the entire length thereof. A multiplicity of pin fins 5 are provided in the inner cavity, being fixed to wall thereof. An enlarged cavity 6 is formed in the shroud 2 of a terminal end of the blade 1. Cooling air entering the inner cavity 10 of the blade 1 flows into the enlarged cavity 6 and flows out of the shroud 2 downwardly through holes 7 of a peripheral portion of the enlarged cavity 6. The entire portion of the shroud 2 is cooled uniformly, and the cooling effect of the entire blade is enhanced by an enhanced heat transfer rate in the blade and by uniform cooling of the entire shroud.

6 Claims, 10 Drawing Sheets

GAS TURBINE MOVING BLADE

BACKGROUND OF THE INVENTION

1. Field of the Invention

The present invention relates generally to a moving blade of a gas turbine used for thermal power generation, etc., and more specifically to a moving blade in which a cooling structure of a shroud is simplified and the cooling performance thereof is enhanced.

2. Description of the Prior Art

FIG. 18 is a view showing a representative moving blade of a gas turbine in the prior art, wherein FIG. 18(*a*) is a longitudinal cross sectional view thereof and FIG. 18(*b*) is a cross sectional view taken on line M—M of FIG. 18(*a*). In the figure, numeral 221 designates a moving blade, numeral 222 designates a shroud at a terminal end thereof and numeral 223 designates a fin provided on the shroud 222. Numeral 224 designates a plurality of holes bored in the moving blade 221, numeral 225 designates a multiplicity of pin fins provided on an inner wall of the moving blade 221 and numeral 226 designates a rib for supporting a cavity 229. Numeral 227 designates a hub portion, numeral 228 designates a blade root portion and numeral 229 designates the cavity as mentioned above.

FIG. 19 is a cross sectional view taken on line N—N of FIG. 18(*a*) and FIG. 20 is a cross sectional view taken on line P—P of FIG. 19. In FIGS. 19 and 20, there are formed two cavities 230, 231, which are independent of each other, in the shroud 222. The cavities 230, 231 are closed at their interiors by plugs 232, 233, respectively, inserted into upper surface portions thereof, and the holes 224 of the moving blade 221 connect to the cavities 230, 231, respectively, so that cooling air is supplied therethrough into the cavities 230, 231. Also provided in the shroud 222 are a plurality of cooling holes 234 which extend from the cavities 230, 231 to open at mutually opposing side ends of the shroud 222 so that the cooling air flows out therefrom.

In the moving blade constructed as mentioned above, the cooling air flows into the cavity 229 through the blade root portion 228, as shown by arrows in FIG. 18, for cooling of a blade base portion, with the heat transfer rate being enhanced by the pin fins 225, to then be led into a terminal end portion of the blade through the holes 224. The cooling air enters the cavities 230, 231 of the shroud 222 to flow through the cooling holes 234 in mutually opposing directions for cooling of the entire portion of the shroud 222, and then flows out of both of the mutually opposing side ends of the shroud 222.

In the moving blade 221, there is provided the shroud 222 at the terminal end of the moving blade 221, as mentioned above, and the shroud 222 is formed integrally with the moving blade 221. The shroud 222 itself functions to reduce gas leaking through the terminal end of the moving blade 221 and is arranged to form a series of blade groups, wherein mutually adjacent shrouds 222 are jointed together with their end faces being connected by pressing against each other, so that vibration proofing of the moving blade 221 is enhanced. In the moving blade 221, vibrations occur in two directions, of the axial direction and radial direction, but the shroud 222 is made with its end face being formed obliquely, and thereby the vibrations in both directions are suppressed. Also, there is provided the fin 223 to the shroud 222 by cutting, the object of which is to reduce gas leaking through the terminal end of the moving blade 221 and to prevent the shroud 222 from making contact with a casing side component.

As mentioned above, in the prior art gas turbine moving blade, the cooling air flows through the holes 224 of the moving blade 221 to join in the cavities 230, 231 and then flows therefrom through the cooling holes 234 of the shroud 222 in the mutually opposing directions for cooling of the entire portion of the shroud 222 to flow out of both of the mutually opposing side ends of the shroud 222. That is, in terms of the flow of the cooling air in the shroud, there are provided the plurality of cooling holes 234 extending from each of the cavities 230, 231 to both of the side ends of the shroud 222, and there is a difference in the resistance between each of the cooling holes 234, so that the flow rate of the cooling air therein differs corresponding to each of the cooling holes 234. The cooling air thus does not flow uniformly therein and a uniform distribution adjustment of the cooling air is difficult, with the result that a uniform cooling of the shroud is not effected under the present circumstances.

SUMMARY OF THE INVENTION

In view of the problems in the prior art cooling structure of the gas turbine moving blade, it is an object of the present invention to provide a gas turbine moving blade constructed such that a cooling effect by convection of the blade interior is enhanced and a flow adjustment of the cooling air entering cooling holes in a shroud is facilitated, with the result that uniform cooling of the shroud is realized.

It is also an object of the present invention to provide a gas turbine moving blade in which a structure of the moving blade is simplified, with the cooling effect of the blade interior being enhanced and the cooling air, entering two mutually independent cavities in the shroud, flowing through the shroud uniformly as much as possible with a smooth inflow into the shroud being ensured.

In order to achieve the objects, the present invention provides in the following (1) to (10):

(1) A gas turbine moving blade is constructed such that there are provided a shroud at a terminal end of the blade and a cooling passage extending in the blade from a base portion to the terminal end thereof Cooling air is led into the shroud through the cooling passage and flows out of a peripheral portion of the shroud. An enlarged cavity is formed in the shroud so that the enlarged cavity connects to the cooling passage of the blade as well as connects to a plurality of holes provided in both of mutually opposing side portions of the shroud so as to open downwardly in a lower surface portion of the shroud.

(2) A gas turbine moving blade as mentioned in (1) above can be characterized in that the cooling passage of the blade is formed by a cavity extending in the blade over the entire length thereof and that there are provided a multiplicity of pin fins to a wall of the cavity.

(3) A gas turbine moving blade as mentioned in (1) above, can be further characterized in that the cooling passage of the blade is formed by a cavity having therein a multiplicity of pin fins on a base portion side of the blade and by a multiplicity of slender holes extending in the blade toward the terminal end thereof on an end portion side of the blade.

In the invention of (1) above, there is formed the enlarged cavity in the shroud so that the shroud interior is occupied almost entirely by the enlarged cavity and the plurality of holes are provided in the peripheral portion of the shroud. Thus, the cooling air flowing from the cooling passage of the moving blade fills in the enlarged cavity so that the main portion of the enlarged cavity is cooled. Further, the cooling air flows out of the shroud through the holes provided in the peripheral portion of the shroud, hence the cooling air in the enlarged cavity flows from the central portion to the peripheral portion of the shroud and the cooling effect of the shroud main portion is enhanced. Also, the cooling air flows out downwardly of the holes, hence the peripheral portion of the shroud is cooled effectively so that the entire portion of the shroud is uniformly cooled.

In the invention of (2) above, the shroud of (1) above is provided to the terminal end of the blade wherein the blade is constructed with the cavity extending in the blade over the entire length thereof and the multiplicity of pin fins are provided in the cavity. Also, in the invention of (3) above, the shroud of (1) above is provided to the terminal end of the blade wherein the blade is constructed by the cavity having the pin fins on the blade base portion side and by the multiplicity of slender holes on the blade end portion side. Hence, the shroud can be applied to a moving blade having any type of cooling structure, the cooling effect of the moving blade is improved by the heat transfer rate being enhanced and the entire portion of the shroud is cooled uniformly so that the entire cooling effect of the moving blade can be enhanced.

(4) A gas turbine moving blade is constructed such that there is provided a shroud at a terminal end of the blade and cooling air is led into the blade to flow from a base portion to the terminal end thereof to then be led into the shroud and flow out of a multiplicity of cooling passages provided in the shroud. There is formed a cavity extending in the blade over the entire length thereof. A multiplicity of pin fins are arranged in the cavity being supported by a wall of the cavity. The cooling passages provided in the shroud are arranged such that each of the cooling passages, at its one end, connects to the cavity formed in said blade, and at its other end, opens in one side portion of mutually opposing side portions of the shroud.

In the invention of (4) above, there is provided in the blade the cavity extending over the entire length of the blade, and the multiplicity of pin fins, supported by the cavity wall, are arranged in the cavity, hence the convection of the cooling air is promoted so as to enhance the heat transfer rate and the blade is cooled effectively. Also, the multiplicity of pin fins are fixed to the wall of the cavity, that is, the inner wall of the blade, whereby the cavity itself is also supported by the pin fins and the strength of the blade is enhanced.

Further, the cooling air which has cooled the blade enters each of the cooling passages of the shroud directly from the cavity of the blade and the cooling passages of the shroud are arranged so that the cooling air flows toward both side portions of the shroud. Hence the cooling air flows into each of the cooling passages of the shroud smoothly and the entire portion of the shroud can be cooled effectively. Thus, a synergistic effect is generated by the cooling effect of the cavity and the pin fins in the blade and by the smooth inflow of the cooling air into the entire portion of the shroud, and the cooling effect of the entire moving blade is enhanced.

(5) A gas turbine moving blade is constructed such that there are provided a shroud at a terminal end of the blade and a cooling passage extending in the blade from a base portion to the terminal end thereof Cooling air is led into the shroud through the cooling passage and flows out of a peripheral portion of the shroud. There are formed in the shroud two mutually independent cavities, each connecting to the cooling passage provided in the blade as well as connecting to a plurality of cooling holes provided in the shroud for conducting therethrough the cooling air toward mutually opposing side portions of the shroud. The cooling holes are formed linearly to extend inclinedly downwardly so as to open in a peripheral lower surface portion of the shroud.

(6) A gas turbine moving blade as mentioned in (5) above is characterized in that the cooling passage of the blade is formed by a cavity extending in the blade over the entire length thereof, and there are provided a multiplicity of pin fins to a wall of the cavity.

(7) A gas turbine moving blade as mentioned in (5) above can be characterized in the cooling passage of the blade being formed by a cavity having therein a multiplicity of pin fins on a base portion side of the blade and by a multiplicity of slender holes extending in the blade toward the terminal end thereof on an end portion side of the blade.

In the invention of (5) above, there are provided two cavities in the shroud, and the cooling holes of the shroud connecting to each of the cavities are formed linearly to extend inclinedly downwardly to open in the peripheral lower surface portion of the shroud. Hence the cooling air flows in the shroud inclinedly downwardly to cool both the upper and lower portions of the shroud in the thickness direction thereof and also the peripheral portion of the shroud, which is exposed to the main flow gas, and the lower surface portion of the shroud, which is in a severe thermal environment, are cooled effectively, and the entire portion of the shroud can be cooled uniformly.

In the invention of (6) above, the shroud of (5) above is provided to the terminal end of the blade, wherein the blade is constructed by the cavity extending in the blade over the entire length of the blade, and the pin fins are provided in the cavity. In the invention of (7) above, the shroud of (5) above is provided to the terminal end of the blade wherein the blade is constructed by the cavity having the pin fins on the blade base portion side and by the multiplicity of slender holes on the blade end portion side. Hence, the shroud can be applied to a moving blade having any type of cooling structure, the cooling effect of the moving blade is improved by the heat transfer rate being enhanced and the entire portion of the shroud is cooled uniformly, so that the entire cooling effect of the moving blade can be enhanced.

(8) A gas turbine moving blade is constructed such that there is provided a shroud at a terminal end of the blade and cooling air is led into the blade to flow through a multiplicity of cooling holes provided in the blade to then be led into the shroud and flow out of a multiplicity of cooling passages provided in the shroud. The multiplicity of cooling holes of the blade and the multiplicity of cooling passages of the shroud are sectioned into two groups, respectively. There are formed in the shroud two cavities, each connecting to each one of the groups of cooling holes of the blade as well as connecting to one of the groups of cooling passages of the shroud. The groups of the cooling passages of the shroud are arranged so that the cooling air flowing therethrough flows out of mutually opposing side portions of the shroud.

In the invention of (8) above, the cooling holes of the blade are sectioned into two groups so as to connect to the mutually independent cavities in the form of one group to one cavity and the cooling air coming from the cooling holes of the blade is once stored in the cavities. Also, the cooling passages of the shroud are sectioned into two groups so as to connect to the cavities, one group to one cavity, thus the cooling air flows from the two cavities toward the mutually opposing side portions of the shroud through the respective cooling passages of the shroud.

The cooling air from each of the cavities flows in the shroud only in one direction toward one of the mutually opposing side portions of the shroud, as mentioned above. Hence the flow control of the cooling air is simplified as compared with the construction of the prior art where the cooling air from each of the cavities flows through the multiplicity of cooling passages in both directions toward the side portions of the shroud. Thus, a uniform flow of the cooling air is ensured in both of the side portions of the shroud and advantages in the design and manufacture of the blade are obtained, with the result that the entire portion of the shroud is cooled uniformly with facilitated flow control of the cooling air.

(9) A gas turbine moving blade is constructed such that there are provided a shroud at a terminal end of the blade and a cooling passage extending in the blade from a base portion from the terminal end thereof and cooling air is led into the shroud through the cooling passage and flows out of a peripheral portion of the shroud. The cooling passage of the blade is formed by a cavity having therein a multiplicity of pin fins on a base portion side of the blade and by a multiplicity of slender holes extending in the blade toward the terminal end thereof on an end portion side of the blade. The length of the slender holes on the end portion side of the blade is ½ or less of the entire length of the blade.

(10) A gas turbine moving blade as mentioned in (9) above is, characterized in that there are provided in the shroud a multiplicity of cooling holes, each connecting to one of the slender holes of the blade. The multiplicity of cooling holes are arranged so that the cooling air flows therethrough alternately toward mutually opposing side portions of the shroud.

In the invention of (9) above, the base portion side of the blade is constructed by the cavity and the multiplicity of pin fins provided in the cavity. The longitudinal length of the cavity is set to ½ or more of the entire length of the blade. Hence the convection of the cooling air in the cavity is promoted by the pin fins so as to enhance the heat transfer rate and the main portion of the blade is cooled effectively. Also, the length of the slender holes on the end portion side of the blade is shortened as compared with the prior art case and the work process of the blade becomes facilitated.

In the invention of (10) above, the end portion side of the blade is cooled by the cooling air flowing through the slender holes, and then the cooling air enters the shroud. Each of the cooling holes of the shroud connects, one to one, to one of the slender holes of the blade. Moreover, the cooling holes are arranged so as to be directed alternately toward the mutually opposing side portions of the shroud. Hence, the cooling air flows uniformly in both of the side portions of the shroud and the entire portion of the shroud can be cooled uniformly. Also, the slender holes of the blade connect to the cooling holes of the shroud, one to one, so that flow control of the cooling air becomes facilitated and the uniform cooling of the shroud is attained easily by an appropriate flow control of the cooling air.

DESCRIPTION OF THE PREFERRED EMBODIMENTS

Figure 1:
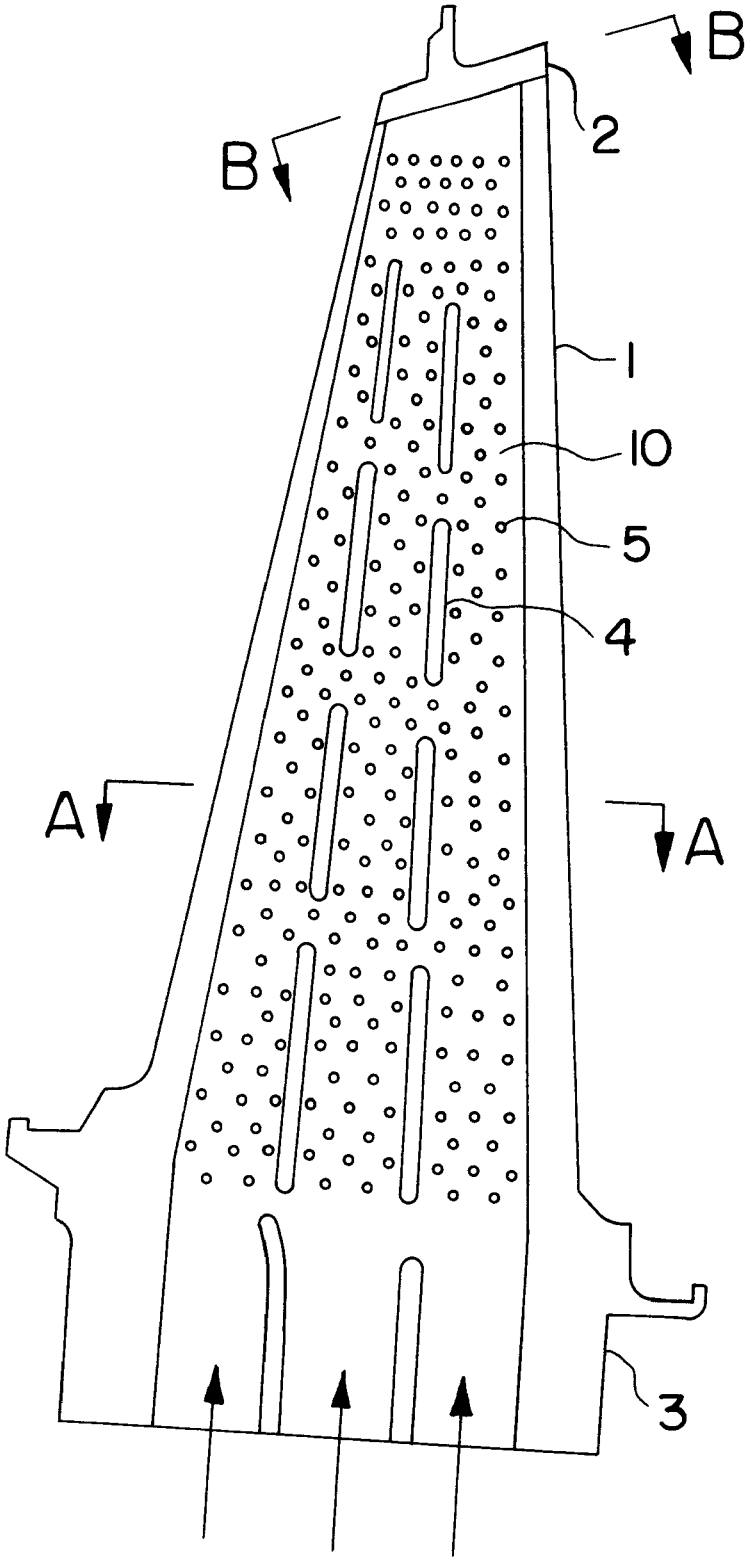
FIG. 1 is a longitudinal cross sectional view of a gas turbine moving blade of a first embodiment according to the present invention.

Herebelow, embodiments according to the present invention will be described concretely with reference to the figures. FIG. 1 is a longitudinal cross sectional view of a gas turbine moving blade of a first embodiment according to the present invention. In FIG. 1, numeral 1 designates a moving blade, numeral 2 designates a shroud at a terminal end thereof and numeral 3 designates a blade root portion. Numeral 4 designates a rib, which, not necessarily relating to the present invention, supports an inner cavity 10 formed in the blade at the time of manufacture. Numeral 5 designates a multiplicity of pin fins provided fixedly to both side walls of the inner cavity 10 or both inner walls of the blade 1. The pin fin 5 is not limited to that having both its ends supported by the wall of the cavity, but may be a projection fixed to one wall thereof Numeral 10 designates the inner cavity as mentioned above.

The moving blade of the first embodiment is constructed such that the inner cavity 10 is formed therein extending over the entire length of an interior of the blade, with the multiplicity of pin fins 5 being provided so that the flow and convection of cooling air therein are improved so as to enhance the cooling effect as well as cooling of the shroud at the terminal end of the moving blade, as featured and described below.

Figure 2:
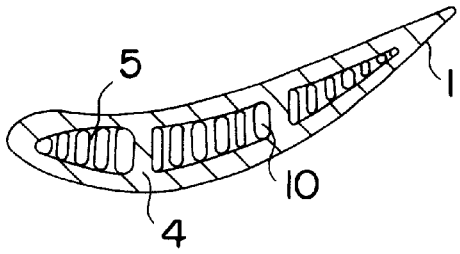
FIG. 2 is a cross sectional view taken on line A—A of FIG. 1.
Figure 3:
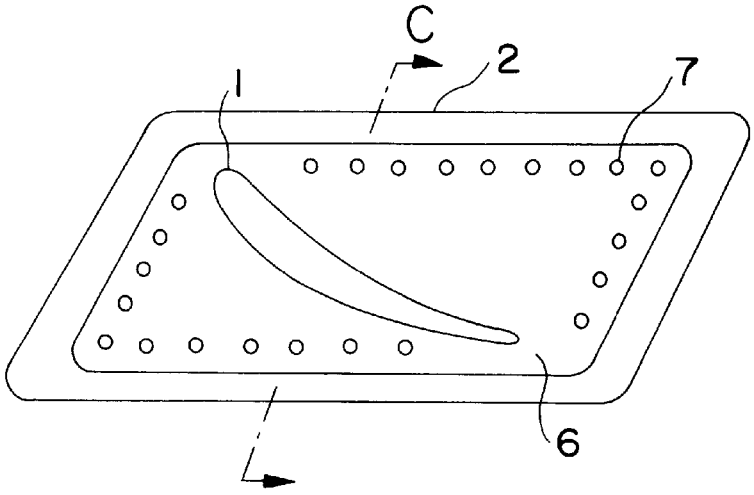
FIG. 3 is a cross sectional view taken on line B—B of FIG. 1.

FIG. 2 is a cross sectional view taken on line A—A of FIG. 1 and FIG. 3 is a cross sectional view taken on line B—B of FIG. 1. In FIGS. 2 and 3, there is provided an enlarged cavity 6 in the shroud 2, i.e. a space is surrounded by a periphery of the shroud 2 so as to form the cavity 6 therein.

Figure 4:
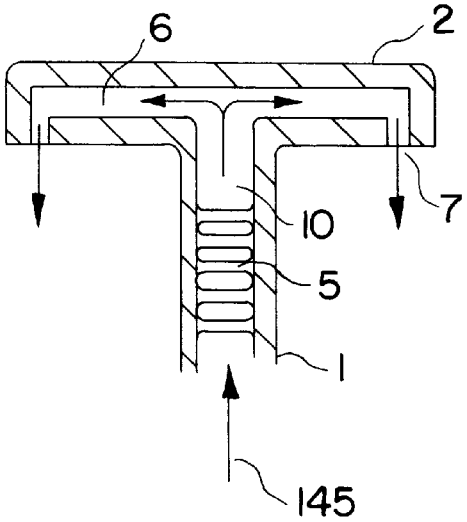
FIG. 4 is a cross sectional view taken on line C—C of FIG. 3.

FIG. 4 is a cross sectional view taken on line C—C of FIG. 3. The enlarged cavity 6 connects to the inner cavity 10 of the moving blade 1 so that cooling air 145 is led into the enlarged cavity 6. In a peripheral portion of the shroud 2, as shown in FIG. 3, there are provided a multiplicity of holes 7 connecting to the enlarged cavity 6 and being directed downwardly so that the cooling air in the enlarged cavity 6 flows out downwardly therethrough.

In the moving blade of the first embodiment constructed as mentioned above, the cooling air 145 flows into the blade interior through the blade root portion 3 to become turbulent due to the multiplicity of pin fins 5 in the inner cavity 10 for cooling of the blade. The heat transfer rate is improved thereby, and cooling air then flows into the shroud 2.

The cooling air which has entered the shroud 2 fills in the enlarged cavity 6 to raise the pressure therein. When the pressure comes to a predetermined pressure or more, the cooling air flows downwardly through the holes 7 of the shroud peripheral portion. Thus the cooling air in the enlarged cavity 6 flows from a central connection portion with the inner cavity 10 toward the shroud peripheral portion, and an upper surface portion and a lower surface portion of the shroud 2 are cooled uniformly.

As the cooling air flows out of the holes 7 downwardly, the peripheral portion of the shroud 2, which is hard to be cooled usually, is cooled effectively. Thus the central portion of the shroud 2 is cooled by the enlarged cavity 6 and the peripheral portion thereof is cooled mainly by the holes 7, respectively, whereby the entire portion of the shroud 2 can be cooled uniformly.

Figure 5:
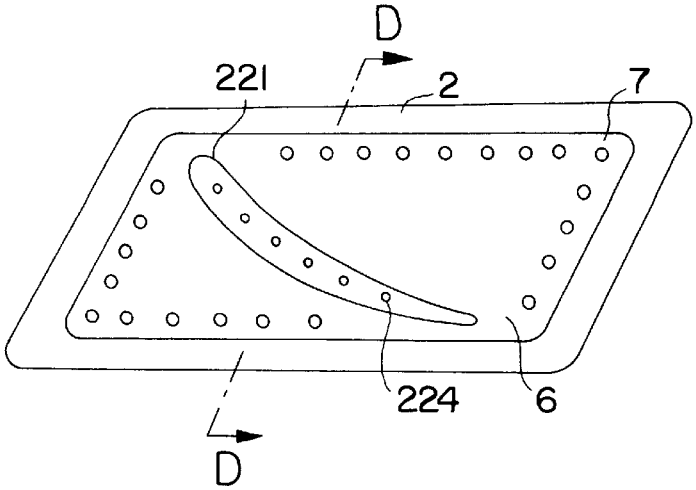
FIG. 5 is a cross sectional view of a shroud of gas turbine moving blade of a second embodiment according to the present invention.
Figure 6:
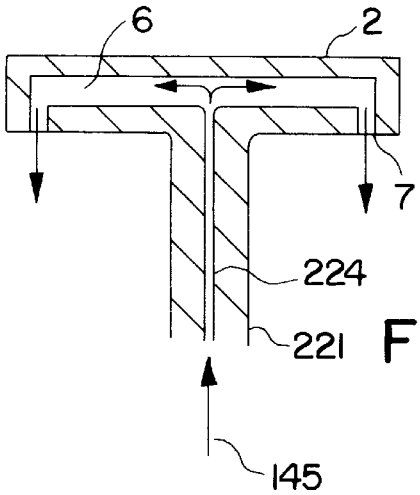
FIG. 6 is a cross sectional view taken on line D—D of FIG. 5.

FIG. 5 is a cross sectional view of a shroud employed in a gas turbine moving blade of a second embodiment according to the present invention and FIG. 6 is a cross sectional view taken on line D—D of FIG. 5. This moving blade of the second embodiment is substantially the same as the prior art described in FIG. 18, and the illustration of the present invention of FIG. 5 corresponds to that of FIG. 19 showing the cross sectional view taken on line N—N of FIG. 18. Hence, the reference numerals of the moving blade are the same as those shown in FIG. 18, with description of the moving blade being omitted. Description based on FIGS. 5 and 6 will be made.

In FIG. 5, the arrangement of the shroud 2, the enlarged cavity 6 and the multiplicity of holes 7 is the same as in the first embodiment shown in FIG. 3. The enlarged cavity 6 connects to the plurality of holes 224. Other portions of the structure are the same as the first embodiment shown in FIG. 3.

In the moving blade of the second embodiment, as described in the prior art case, the cooling air 145 flows in the interior of the blade from the blade base portion for cooling therearound, with convection being promoted by the pin fins 225, and further flows through the holes 224 for cooling of the terminal end portion of the blade, and then flows into the shroud 2. As the holes 224 and the enlarged cavity 6 of the shroud 2 connect to each other, the cooling air fills in the enlarged cavity 6 to generate a pressure therein of a predetermined level or more to then flow out of the holes 7 of the shroud 2 peripheral portion. The entire portion of the shroud 2, including the peripheral portion thereof, can be cooled uniformly as in the first embodiment.

Figure 7:
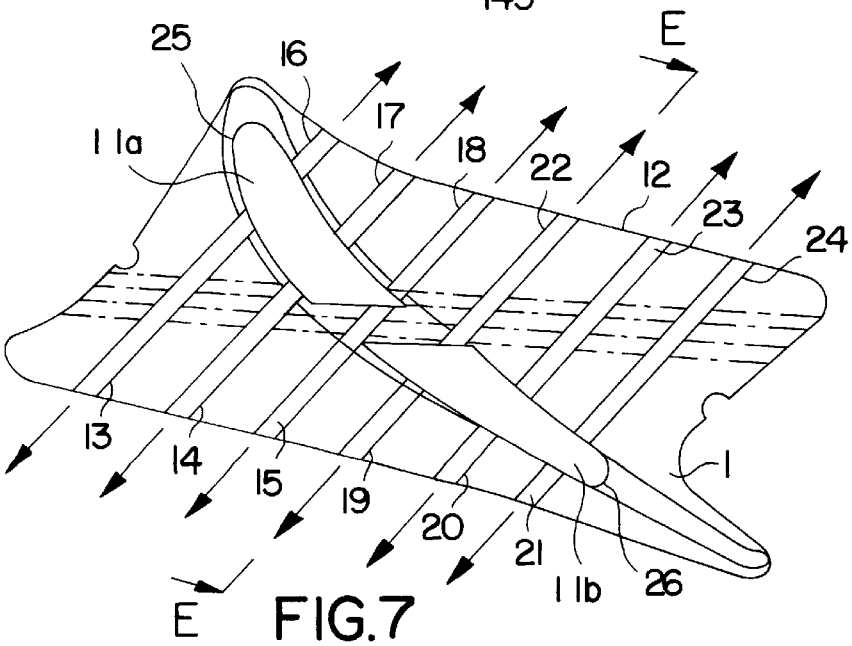
FIG. 7 is a cross sectional view of a shroud of gas turbine moving blade of a third embodiment according to the present invention and corresponds to FIG. 3 showing the cross sectional view taken on line B—B of FIG. 1.

FIG. 7 is a cross sectional view of a shroud employed in a gas turbine moving blade of a third embodiment according to the present invention and corresponds to FIG. 3 showing the cross sectional view taken on line B—B of FIG. 1. In FIG. 7, numeral 12 designates a shroud, and there are provided two mutually independent cavities 11*a,* 11*b* in the shroud 12 so as to connect to the inner cavity 10 of the moving blade 1. Cooling passages 13,14, 15 connect to the cavity 11*a* so that cooling air flows out of one side end portion of the shroud 12 therethrough. Cooling passages 16, 17, 18 also connect to the cavity 11*a,* so as to oppose the cooling passages 13, 14, 15, respectively, and the cooling air flows out of the other side end portion of the shroud 12 therefrom.

Also, cooling passages 19, 20, 21 connect to the cavity 11*b* so that the cooling air flows out of one side end portion of the shroud 12 therethrough. Cooling passages 22, 23, 24 connect to the cavity 11*b* so as to oppose the cooling passages 19, 20, 21, respectively, and the cooling air flows out of the other side end portion of the shroud 12 therefrom. Thus, the cooling air flows out toward both sides of the shroud 12 and the entire portion of the shroud 12 is cooled. Also, as in the prior art case, there are provided plugs 25, 26 in upper surface portions of the cavities 11*a*, 11*b,* respectively, so that the upper surface portions of the cavities 11*a,* 11*b* are closed.

Figure 8:
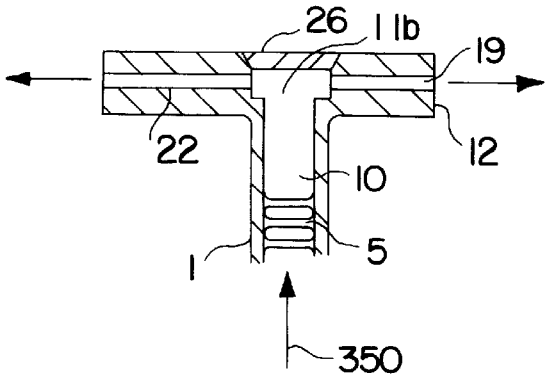
FIG. 8 is a cross sectional view taken on line E—E of FIG. 7.

FIG. 8, is a cross sectional view taken on line EE of FIG. 7. The inner cavity 10 of the moving blade 1 connects to the cavity 11*b* of the shroud 12 and the cooling passages 19, 22, respectively, extend sidewardly from the cavity 11*b* so that the cooling air flows out sidewardly therethrough. The plug 26 is attached to the upper surface portion of the cavity 11*b* so that the cavity 11*b* is closed.

In the moving blade I of the third embodiment constructed as mentioned above, cooling air 350 flows into an interior of the moving blade 1 through the blade root portion 3 to become turbulent due to the multiplicity of pin fins 5 in the inner cavity 10 so that the heat transfer rate is enhanced, flows toward a terminal end portion of the blade while cooling the blade, and then flows into the cavities 11*a,* 11*b* of the shroud 12 smoothly from the inner cavity 10.

The cooling air which has entered the cavity 11*a* of the shroud 12 passes through the cooling passages 13 to 15, 16 to 18 to flow out of mutually opposing side end portions of the shroud 12. Also, the cooling air which has entered the cavity 11*b* of the shroud 12 passes through the cooling passages 19 to 21, 22 to 24 to flow out of the mutually opposing side end portions of the shroud 12. Also, the entire portion of the shroud 12 is cooled.

According to the moving blade of the third embodiment mentioned above, the moving blade is constructed such that the inner cavity 10 is provided in the blade so as to extend over the entire length of the blade. There are provided the multiplicity of pin fins 5 in the inner cavity 10 so that convection of the cooling air is promoted, with the heat transfer rate being enhanced. The cooling air flows into the shroud 12 smoothly, and there are provided, in the shroud 12, the cavities 11*a*, 11*b* and the cooling passages 13 to 24 so that the cooling air flows out toward both of the side end portions of the shroud 12. Thus the entire portion of the shroud 12 is cooled uniformly and the moving blade 1 is cooled with an enhanced cooling effect.

Figure 9:
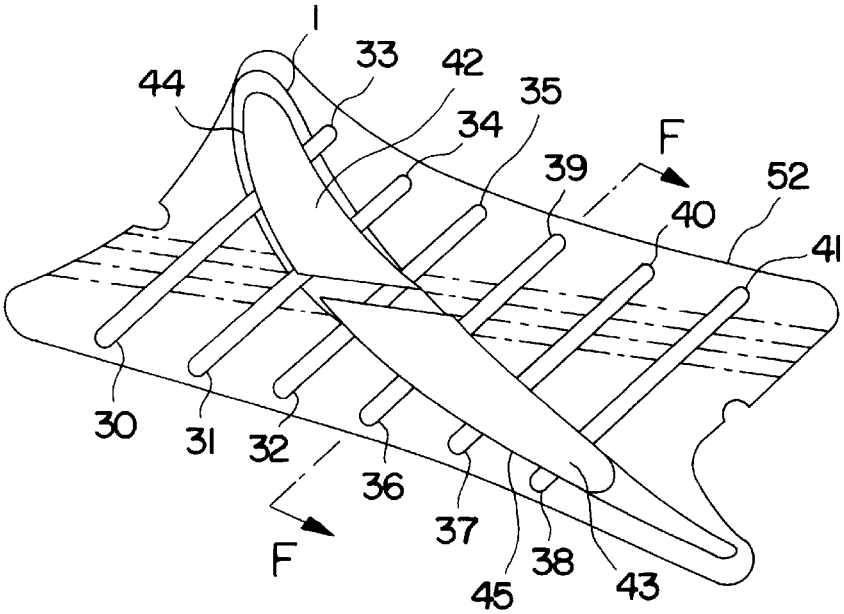
FIG. 9 is a cross sectional view of a shroud of gas turbine moving blade of a fourth embodiment according to the present invention and corresponds to FIG. 3 showing the cross sectional view taken on line B—B of FIG. 1.

FIG. 9 is a cross sectional view of a shroud employed in a gas turbine moving blade of a fourth embodiment according to the present invention and corresponds to FIG. 3 showing the cross sectional view taken on line B—B of FIG. 1. In FIG. 9, numeral 52 designates a shroud, and there are provided two mutually independent cavities 42, 43 in the shroud 52 so as to connect to the inner cavity 10 of the moving blade 1, respectively. As in the prior art case, there are provided plugs 44, 45 in upper surface portions of the cavities 42, 43, respectively, so that the upper surface portions of the cavities 42, 43 are closed. Cooling air flows into the cavities 42, 43, respectively, from the inner cavity 10 of the moving blade 1. Cooling passages 30, 31, 32 connect to the cavity 42 so that the cooling air flows out toward one side of the shroud 52 therethrough and cooling passages 33, 34, 35 also connect to the cavity 42 so as to oppose the cooling passages 30, 31, 32, respectively, and the cooling air flows out toward the other side of the shroud 52 therefrom.

Also, cooling passages 36, 37, 38 connect to the cavity 43 so that the cooling air flows out toward one side of the shroud 52 therethrough and cooling passages 39, 40, 41 connect to the cavity 43 so as to oppose to the cooling passages 36, 37, 38, respectively, and the cooling air flows out toward the other side of the shroud 52 therefrom.

Figure 10:
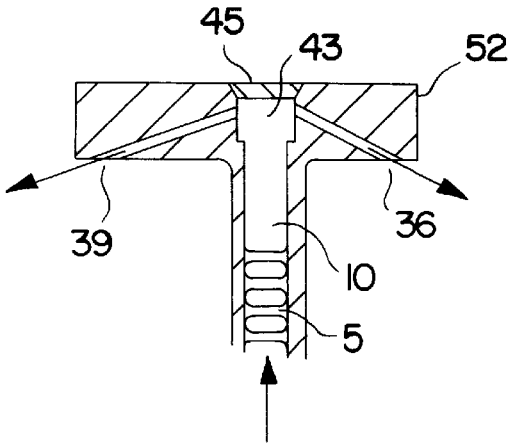
FIG. 10 is a cross sectional view taken on line F—F of FIG. 9.

FIG. 10 is a cross sectional view taken on line F—F of FIG. 9. The inner cavity 10 of the moving blade 1 connects to the cavity 43 of the shroud 52 and the cooling passages 39, 36, respectively, extend inclinedly downwardly in a thickness direction of the shroud 52 so that the cooling air in the cavity 43 flows out inclined relative to a peripheral lower surface portion of the shroud 52. The plug 45 is provided in the upper surface portion of the cavity 43.

In the moving blade 1 of the fourth embodiment constructed as mentioned above, cooling air flows into an interior of the moving blade 1 through the blade root portion to become turbulent by the multiplicity of pin fins 5 in the inner cavity 10 so that the heat transfer effect is enhanced. The air flows toward a terminal end portion of the blade while cooling the blade and then flows into the cavities 42, 43 of the shroud 52 smoothly from the inner cavity 10.

The cooling air which has entered the cavity 42 of the shroud 52 passes through the cooling passages 30 to 32, 33 to 35, respectively, to flow in mutually opposing directions in the shroud 52, wherein the cooling passages 30 to 32, 33 to 35, respectively, are provided inclinedly downwardly in the shroud 52 and the cooling air flows out inclined relative to the peripheral lower surface portion of the shroud 52.

Likewise, the cooling air which has entered the cavity 43 of the shroud 52 passes through the cooling passages 36 to 38, 39 to 41, respectively, to flow in mutually opposing directions in the shroud 52 to flow out inclinedly of the peripheral lower surface portion of the shroud 52. Thus, the cooling air flows in both of the mutually opposing directions in the shroud 52 to flow out inclined relative to the peripheral lower surface portion of the shroud 52, and the entire portion from the central portion to the peripheral portion of the shroud 52 can be cooled uniformly.

Further, the cooling passages are provided inclinedly downwardly toward the peripheral portion of the shroud 52, hence the cooling air flows toward the peripheral portion of the shroud 52 where there is a large thermal influence, and the peripheral portion of the shroud 52 can be cooled effectively.

Figure 11:
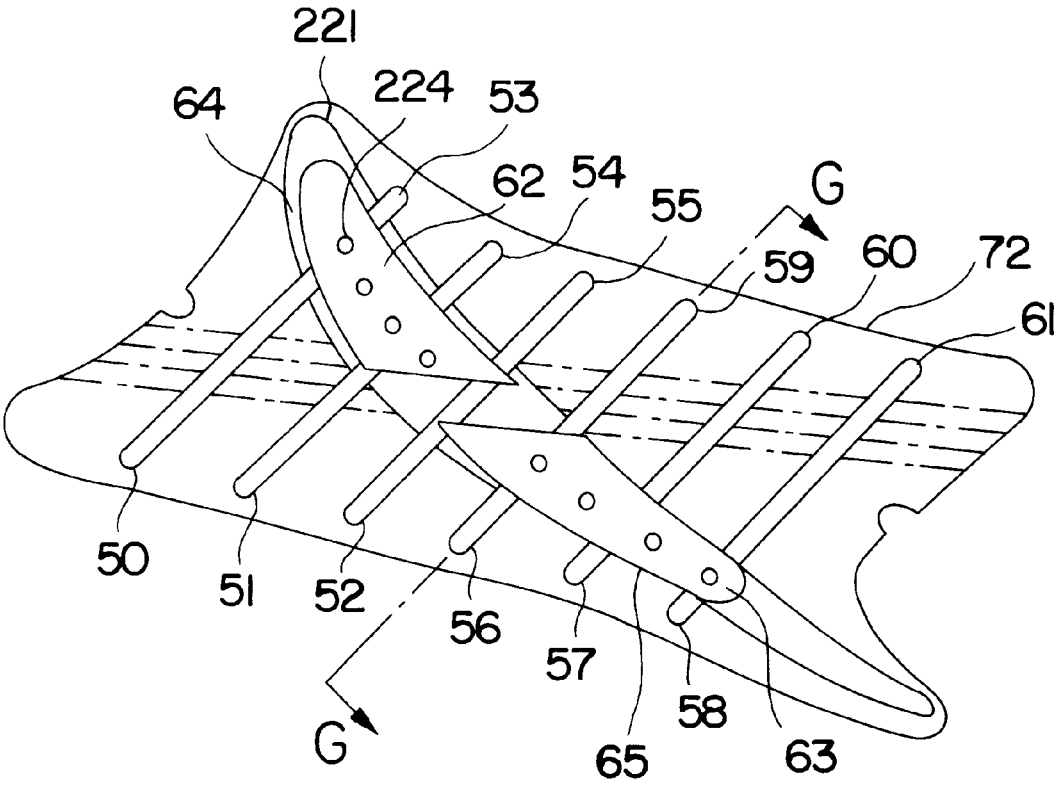
FIG. 11 is a cross sectional view of a shroud of gas turbine moving blade of a fifth embodiment according to the present invention.

FIG. 11 is a cross sectional view of a shroud employed in a gas turbine moving blade of a fifth embodiment according to the present invention. The moving blade portion is made the same as the prior art described in FIG. 18. That is, the base portion of the moving blade comprises the cavity 229 and the pin fins 225 and there are the holes 224 consisting of a multiplicity of slender holes extending from base portion to the terminal end portion. FIG. 11 corresponds therefore to FIG. 19 showing the cross sectional view taken on line N—N of FIG. 18. Description of the moving blade is omitted, with the same reference numerals being used. Thus, a shroud 72, which is a featured portion of the present invention, will be described in detail below.

In FIG. 11, numeral 72 designates the shroud as mentioned above and numerals 62, 63 designate cavities, which are formed mutually independently in the shroud 72. Cooling passages 50, 51, 52 connect to the cavity 62 so as to extend toward one side of the shroud 72 and cooling passages 53, 54, 55 connect to the cavity 62 so as to extend toward the other side of the shroud 72.

Also, cooling passages 56, 57, 58 connect to the cavity 63 so as to extend toward one side of the shroud 72 and cooling passages 59, 60, 61 connect to the cavity 63 so as to extend toward the other side of the shroud 72. There are provided plugs 64, 65 in an upper surface portion of the cavities 62, 63, and this upper surface portion is closed. Construction of the portions is the same as that of the fourth embodiment shown in FIG. 9.

In the moving blade 221, there are provided the holes 224 in the portion from the base portion to the terminal end portion of the blade, as mentioned above, and these holes 224 are sectioned into two groups, one connecting to the cavity 62 and the other connecting to the cavity 63, for leading therethrough the cooling air.

Figure 12:
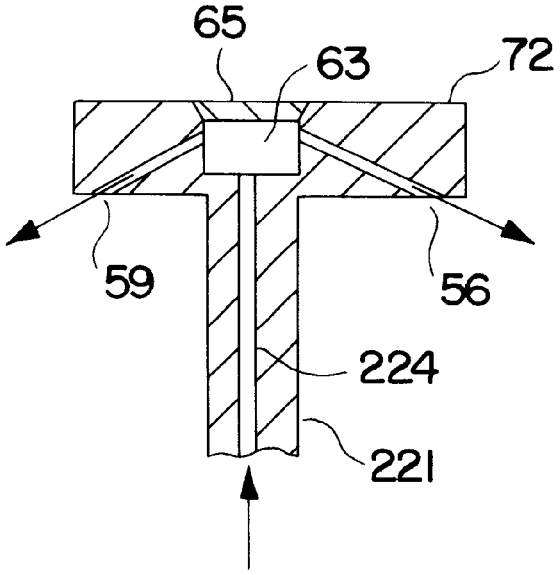
FIG. 12 is a cross sectional view taken on line G—G of FIG. 11.

FIG. 12 is a cross sectional view taken on line G—G of FIG. 11. The cavity 63 is formed in the shroud 72 and the holes 224 of the moving blade 221 connect to the cavity 63 of the shroud 72 so that the cooling air is led into the shroud 72 through the moving blade 221. The cooling passages 59, 56 connect to both sides of the cavity 63 so as to extend inclinedly downwardly toward the respective sides of the shroud 72 in mutually opposing directions so that the cooling air flows inclinedly out of a peripheral lower surface portion of the shroud 72. The plug 65 is provided so as to close the upper surface portion of the cavity 63 as mentioned above.

In the moving blade of the fifth embodiment constructed as above, as described in the prior art case, the cooling air flows into the blade from the blade base portion to cool the blade base portion with convection of the cooling air being promoted by the pin fins 225. It then flows through the holes 224 to cool the end portion of the blade and then enters the shroud 72.

In the shroud 72, there being the holes 224 connecting to the cavities 62, 63, respectively, the cooling air fills in the cavities 62, 63 and then flows toward one side of the shroud 72 through the cooling passages 50 to 52, 56 to 58 and toward the other side through the cooling passages 53 to 55, 59 to 61. Moreover, the cooling air flows out inclinedly downwardly, hence the shroud 72 can be cooled uniformly from the central portion to the peripheral portion, as in the case of the fourth embodiment.

Figure 13:
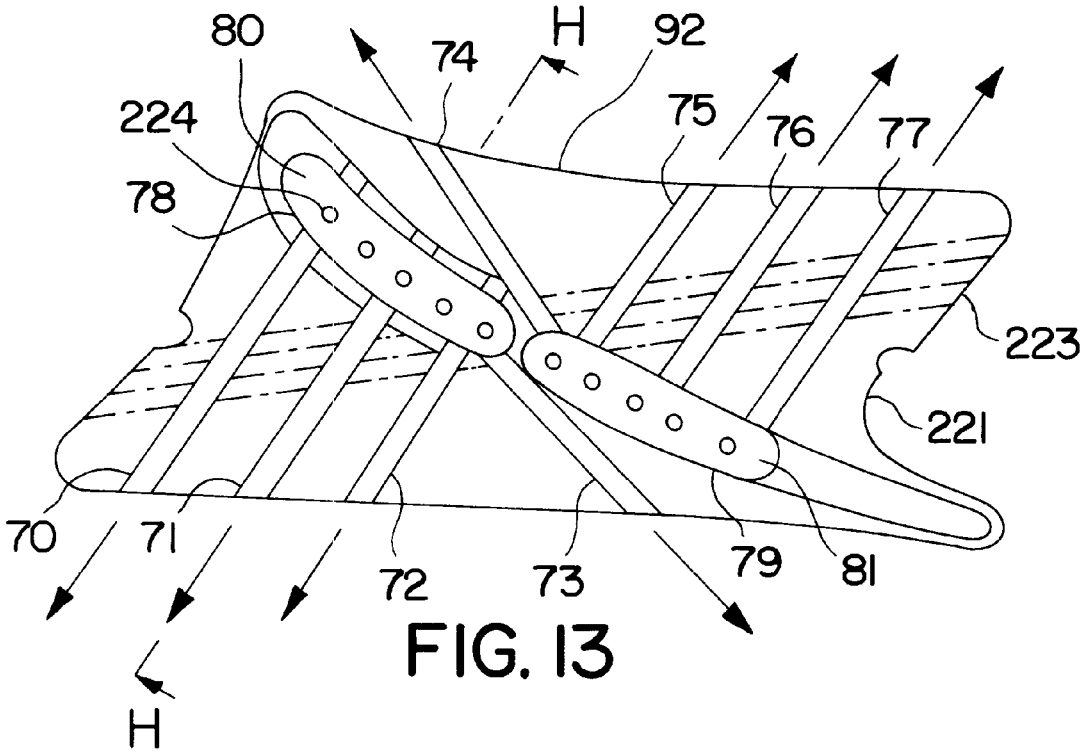
FIG. 13 is a cross sectional view of a shroud of gas turbine moving blade of a sixth embodiment according to the present invention.
Figure 18A:
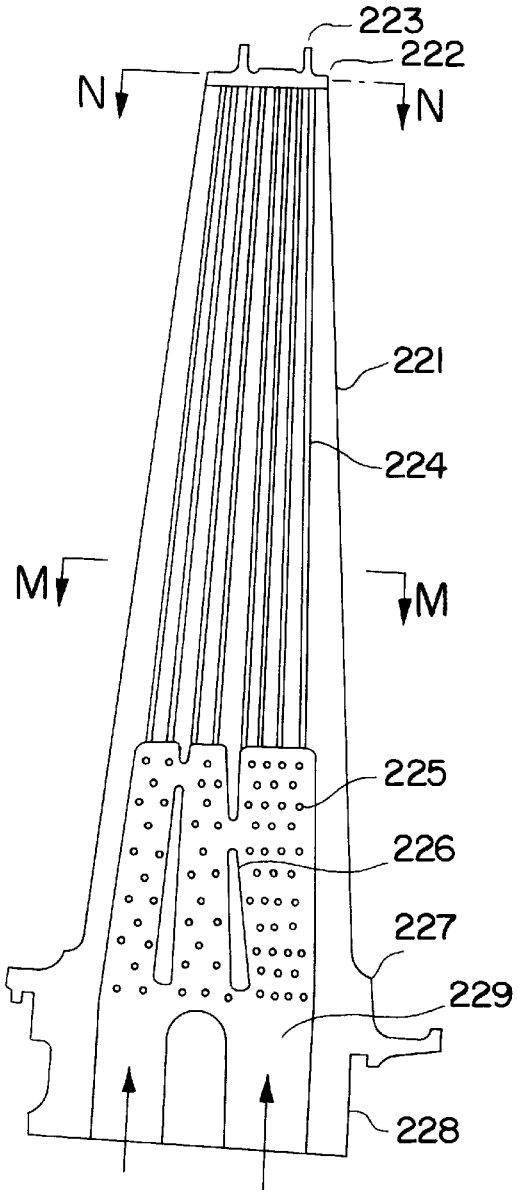
FIG.18(a) PRIOR ART
FIG. 18 is a view showing a representative moving blade of gas turbine in the prior art, wherein FIG. 18(*a*) is a longitudinal cross sectional view thereof and FIG. 18(*b*) is a cross sectional view taken on line M—M of FIG. 18(*a*).
Figure 18B:
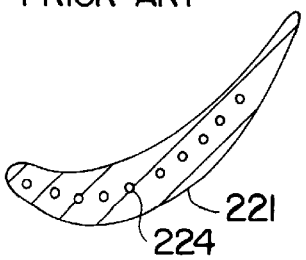
FIG.18(b) PRIOR ART
Figure 19:
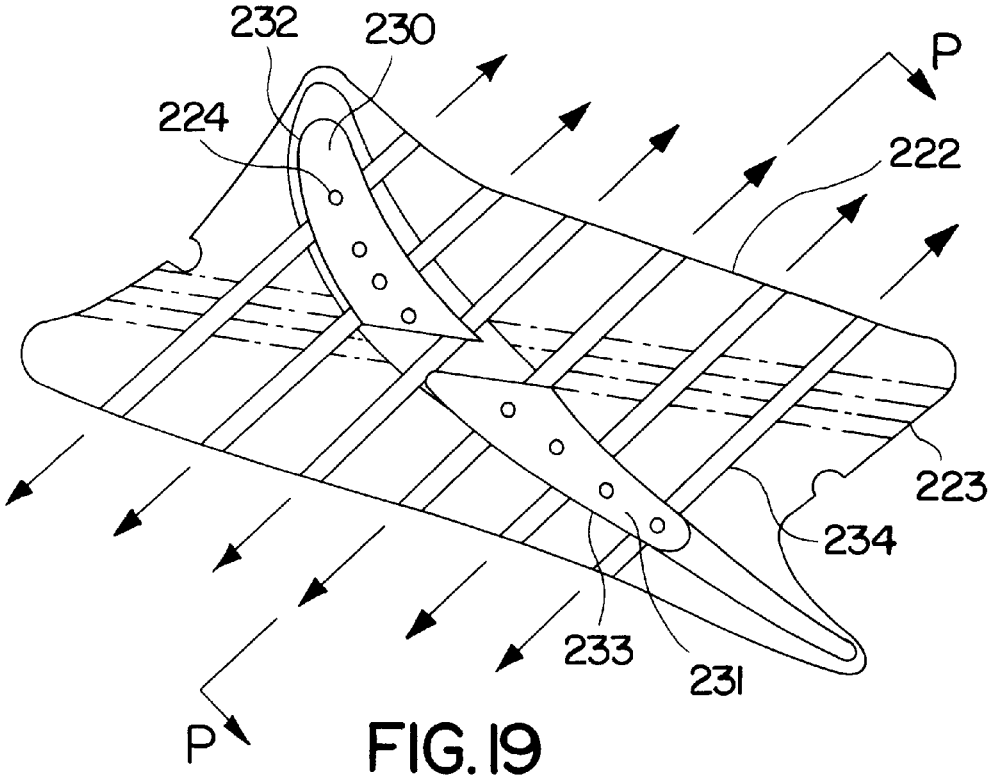
FIG. 19 PRIOR ART
FIG. 19 is a cross sectional view taken on line N—N of FIG. 18(*a*).
Figure 20:
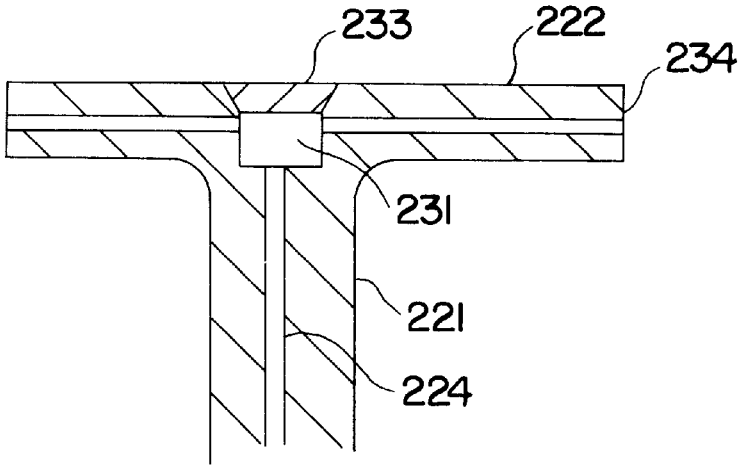
FIG. 20 PRIOR ART
FIG. 20 is a cross sectional view taken on line P—P of FIG. 19.

FIG. 13 is a cross sectional view of a shroud employed in a gas turbine moving blade of a sixth embodiment according to the present invention and corresponds to FIG. 19 showing the cross sectional view taken on line N—N of FIG. 18 of the prior art shroud. The blade portion being the same as in the prior art case, description thereof is omitted and a portion of a shroud 92, which is a featured portion of the present invention, will be described in detail below.

In FIG. 13, numeral 92 designates the shroud as mentioned above and numerals 80, 81 designate cavities, respectively, formed in the shroud 92 along a surface plane thereof Numerals 70, 71, 72, 73 designate cooling passages connecting to the cavity 80, which are bored in the shroud 92 along the surface plane thereof and toward one side thereof, so that cooling air flows out toward the one side only. The cooling air coming into the cavity 80 from the holes 224 is accumulated therein and then flows out into the cooling passages 70 to 73, respectively.

Numerals 74, 75, 76, 77 also designate cooling passages connecting to the cavity 81, which are bored in the shroud 92 along the surface plane thereof and toward the other side thereof, opposite to the side where the cooling passages 70 to 73 are formed, so that cooling air flows out toward the other side only. The cooling air coming into the cavity 81 from the holes 224 is accumulated therein and flows out into the cooling passages 74 to 77, respectively.

Numeral 221 designates the moving blade shown in FIG. 18. Likewise, numeral 223 designates the fin of the shroud, and numeral 224 designates the holes provided in the moving blade 221. Numerals 78, 79 designate plugs to close the cavities 80, 81, respectively, and only the positions of the plugs 78, 79 are shown in FIG. 13.

Figure 14:
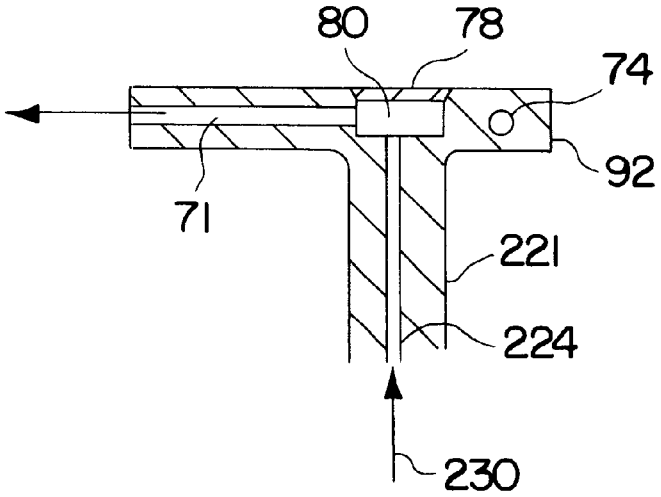
FIG. 14 is a cross sectional view taken on line H—H of FIG. 13.

FIG. 14 is a cross sectional view taken on line H—H of FIG. 13. The holes 224 are provided in the moving blade 221 so as to connect to the cavity 80 of the shroud 92. The plug 78 is provided in the upper surface portion of the cavity 80 and the cavity 80 is closed thereby. The cooling air flows into the cavity 80 through the holes 224 to be accumulated therein.

The cooling passage 71 extends from the cavity 80 toward one side of the shroud 92 so that the cooling air in the cavity 80 flows out therethrough. In the cross section of FIG. 14, there is shown the cooling passage 74 connecting to the other cavity 81 and extending obliquely toward the other side of the shroud 92 of the side where the cooling passage 71 is formed.

In the gas turbine moving blade constructed as mentioned above, cooling air 230 entering the blade base portion cools this portion, with the convection effect of the cooling air being promoted by the pin fins 225, and then flows into the holes 224. The cooling air, while flowing through the holes 224, cools the blade 221 from the central portion to the end portion thereof, and flows into the cavities 80, 81, formed mutually independently in the shroud 92.

The cooling air which has entered the cavity 80 to accumulate therein flows in the cooling passages 70 to 73 from the cavity 80 toward one side only of the shroud 92 for cooling therearound and flows out therefrom. On the other hand, the cooling air which has entered the cavity 81 flows in the cooling passages 74 to 77 for cooling of the other side only of the shroud 92 and flows out therefrom. Thus, according to the moving blade of the sixth embodiment, the entire surface portion of the shroud 92 is cooled effectively and the entire shroud 92 can be cooled uniformly by setting the capacities of the cavities 80, 81 appropriately.

Figure 15:
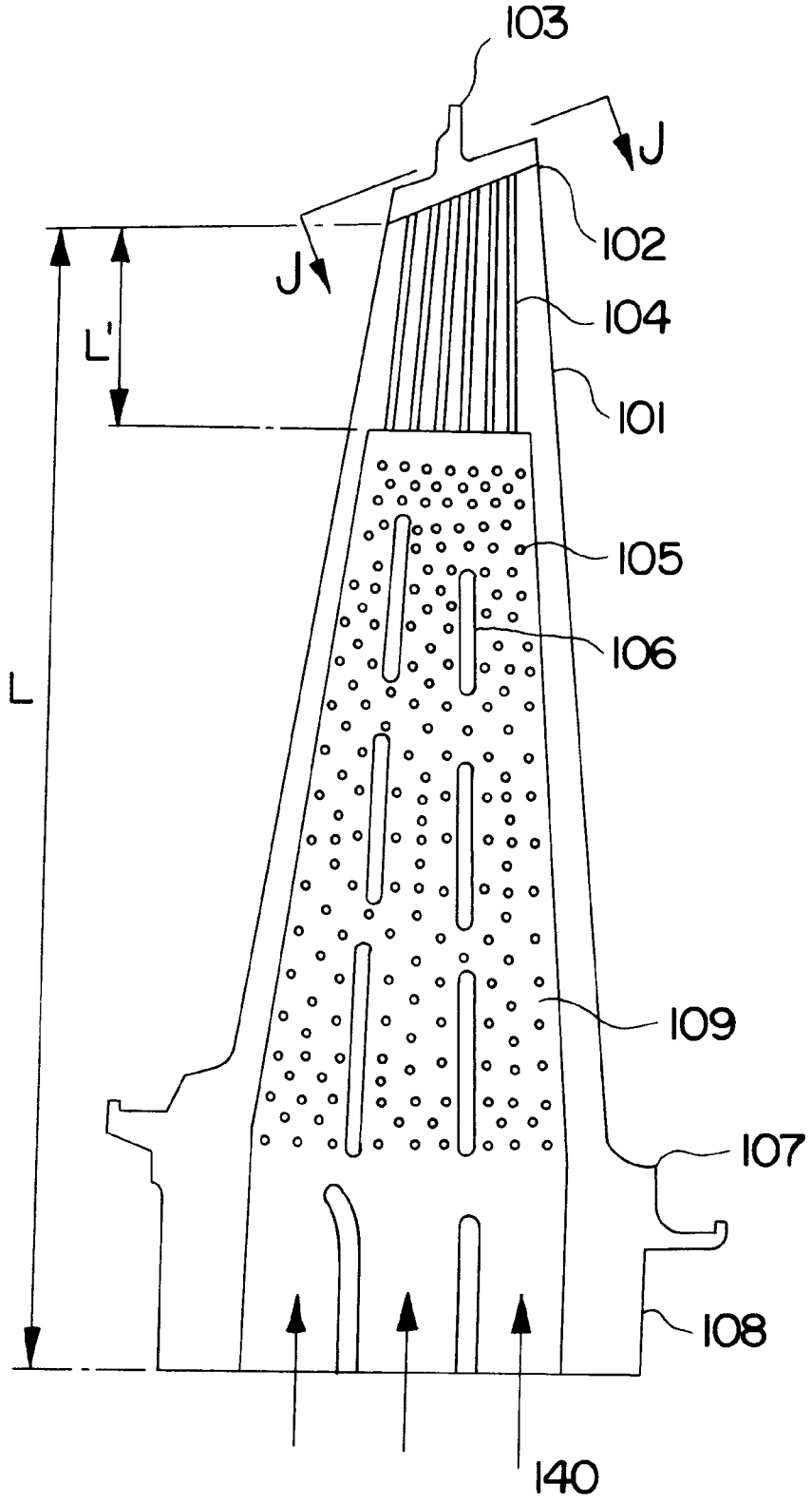
FIG. 15 is a longitudinal cross sectional view of a gas turbine moving blade of a seventh embodiment according to the present invention.

FIG. 15 is a longitudinal cross sectional view of a gas turbine moving blade of a seventh embodiment according to the present invention. Across section of a central portion thereof being the same as that shown in FIG. 2, illustration thereof is omitted. In FIG. 15, numeral 101 designates a moving blade, numeral 102 designates a shroud of a terminal end of the moving blade 101 and numeral 103 designates a fin of the shroud 102. Numeral 104 designates a plurality of holes, consisting of slender holes, provided in a blade portion approaching an end portion of the blade, as compared with the prior art case shown in FIG. 18, as discussed later.

Numeral 105 designates a multiplicity of pin fins supported by both walls of a cavity 109. Numeral 106 designates a rib for supporting the cavity 109. The rib 106, not necessarily relating to the present invention, is formed at the time of manufacture of the blade. Numeral 107 designates a blade hub portion and numeral 108 designates a blade root portion. Cooling air 140 flows into the blade from a base portion of the blade root portion 108.

In the moving blade according to the present invention mentioned above, length L' of the holes 104 is set to ½ or less of an entire length L of the blade and the length of the cavity 109 is set to ½ or more. A multiplicity of the pin fins 105 are arranged over the entire portion of the cavity 109 so that a main portion of the blade is formed by the cavity 109 and the pin fins 105. Thus the blade main portion is filled with cooling air, the cooling effect therein is enhanced and the length of the holes 104 is reduced so that the work process thereof is simplified.

Figure 16:
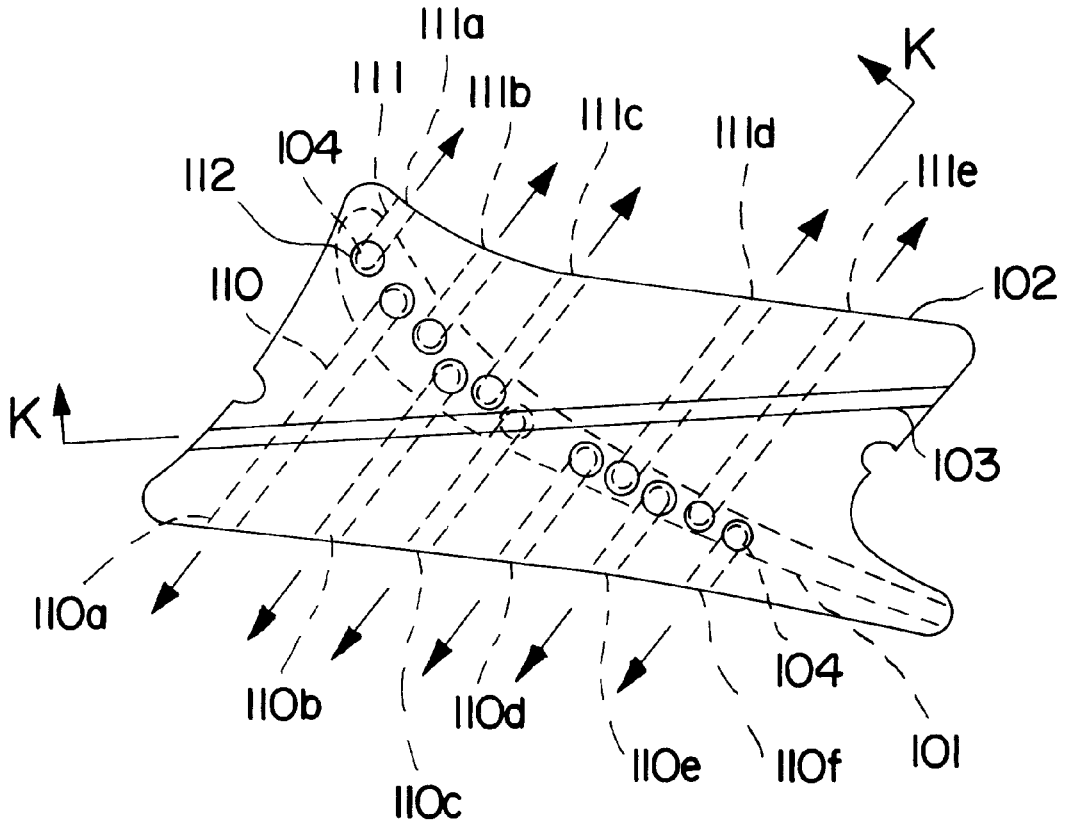
FIG. 16 is a view of the shroud of the seventh embodiment seen from the direction of arrows J—J of FIG. 15.
Figure 17:
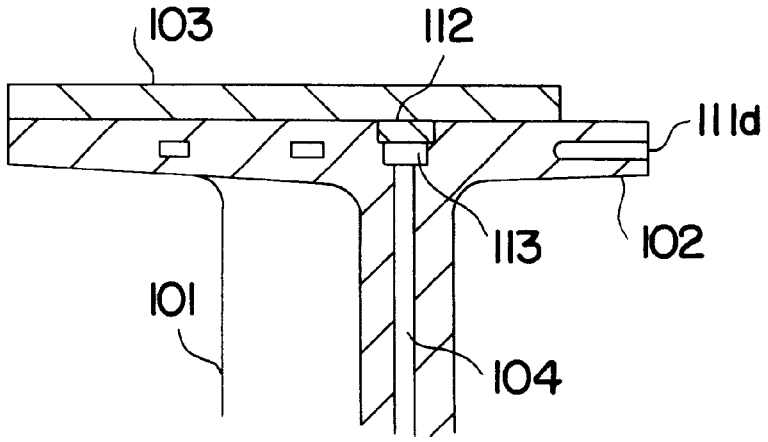
FIG. 17 is a cross sectional view taken on line K—K of FIG. 16.

FIG. 16 is a view of the shroud 102 seen in the direction of arrows J—J of FIG. 15 and FIG. 17 is a cross sectional view taken on line K—K of FIG. 16. In FIGS. 16 and 17, there are provided in the shroud 102 two-step holes 113, each connecting one to one to the holes 104, and plugs 112 are provided in respective upper holes of the two-step holes 113 so that the two-step holes 113 are closed. To each of the two-step holes 113 is connected a cooling hole 110 or 111. The cooling holes 110 and 111 extend in mutually opposite directions in the shroud 102, connecting one to one to the holes 104. As shown in FIG. 16, the cooling holes 110 actually consist of cooling holes 110*a*, 110*b*, 110*c*, 110*d*, 110*e*, 110*f*, all extending toward one side of the shroud 102. The cooling holes 1 11 actually consist of cooling holes 111*a*, 111*b* 111*c*, 111*d*, 111*e*, all extending toward the other side of the shroud 102. The cooling holes 110*a* to 110*f* and the cooling holes 111*a* to 111*e* are arranged to alternate one by one, as 110*a* and 111*a*, 110*b* and 111*b*, and so on. Thus, the cooling air flows through the cooling holes so that the entire portion of the shroud 102 is cooled uniformly.

In providing the cooling holes 110, 111 in the shroud 102, the two step-holes 113 are formed in advance in the shroud 102 at the connecting portion of the holes 104 of the moving blade 101. Then the cooling holes 110, 111 are bored toward the two step holes 113 in the shroud 102 and the upper hole each of the two-step holes 113 is closed by the plug 112.

The plug 112 is inserted into the upper hole of each of the two-step holes 113 to a depth to not close the cooling holes 110, 111 of the shroud 102. The periphery of the plug 112 is fixed by welding or the like.

In the moving blade constructed as above, the cooling air 140 enters the blade from the base portion of the blade root portion 108 for cooling of the main portion of the blade effectively, with the heat transfer rate being enhanced by the pin fins 105 in the cavity 109, and then enters the holes 104 of the end portion of the blade.

The cooling air which has entered the holes 104 cools the end portion of the blade and then enters the shroud 102 to flow through the two-step holes 1113 and the cooling holes 110, 111 connecting, one to one, to the two-step holes 113 for cooling of the entire portion of the shroud 102. The air then flows out of the side end portions of the shroud.

The holes 104 of the blade connect, one to one, to the cooling holes 110, 111 of the shroud 102, as mentioned above. The cooling holes 110, 111 are arranged so that the cooling air flows in alternating mutually reverse directions. Hence the cooling air is distributed uniformly along the plane of the shroud 102 and appropriate flow control of the cooling air in the shroud 102 becomes facilitated so that the cooling air is used effectively.

According to the moving blade of the seventh embodiment, the base portion side of the moving blade 101 is constructed by the cavity 109 and the pin fins 105 and the end portion side thereof is constructed by the holes 104. The length of the base portion side of the blade is set to at least ½ of the entire length of the blade, whereby the cooling effect of the blade by the convection of the cooling air is enhanced. The holes 104 being made shorter as compared with the prior art, the work (forming) process thereof becomes easier.

Further, in addition to the above effect, the cooling holes 110, 111 provided in the shroud 102 along the plane thereof connect, one to one, to the holes 104 of the blade. The cooling air flows through the cooling holes 110, 111 in alternating mutually reverse directions, whereby flow control of the cooling air is facilitated and the cooling air can be distributed in the shroud uniformly so that the shroud 102 is cooled uniformly.

It is understood that the invention is not limited to the particular construction and arrangement herein illustrated and described but embraces such modified forms thereof as come within the scope of the following claims.

What is claimed is:

1. A gas turbine moving blade comprising:

a blade having a terminal end and a base portion;

a shroud at said terminal end of said blade, said shroud having mutually opposing side portions, a lower surface portion and a peripheral portion;

an enlarged cavity in said shroud;

a cooling passage extending in said blade from said base portion to said terminal end, connecting with said enlarged cavity, and leading cooling air into said shroud, said cooling passage being formed by a cavity extending in said blade over the entire length of said blade, and said cavity having a wall provided with a plurality of pin fins; and a plurality of holes provided in both of said mutually opposing side portions of said shroud so as to open downwardly in said lower surface portion of said shroud at said peripheral portion, said enlarged cavity connecting with said plurality of holes so that air led into said shroud through said cooling passage flows out of said peripheral portion of said shroud.

2. A gas turbine moving blade comprising:

a blade having a terminal end and a base portion;

a shroud at said terminal end of said blade, said shroud having mutually opposing side portions;

a cavity extending in said blade over the entire length of said blade, said cavity having a wall;

a plurality of pin fins arranged in said cavity and supported by said wall of said cavity; and a plurality of cooling passages provided in said shroud, each of said plurality of cooling passages having one end connecting to said cavity formed in said blade and an other end opening on one side portion of said mutually opposing side portions of said shroud.

3. A gas turbine moving blade comprising:

a blade having a terminal end and a base portion;

a shroud at said terminal end of said blade, said shroud having mutually opposing side portions and a peripheral lower surface portion;

two mutually independent cavities in said shroud;

a cooling passage extending in said blade from said base portion to said terminal end, connecting with each of said mutually independent cavities, and leading cooling air into said shroud, said cooling passage being formed by a cavity extending in said blade over the entire length of said blade, and said cavity having a wall provided with a plurality of pin fins; and each of said two mutually independent cavities connecting to a plurality of cooling holes provided in said shroud for conducting cooling air therethrough toward said mutually opposing side portions of said shroud, said cooling holes extending linearly and inclinedly downwardly so as to open on said peripheral lower surface portion of said shroud so that cooling air led into said shroud through said cooling passage flows out of a peripheral portion of said shroud.

4. A gas turbine moving blade comprising:

a blade having a terminal end;

a shroud at said terminal end of said blade;

a plurality of cooling holes in said blade leading air through said blade to then be led into said shroud and a plurality of cooling passages in said shroud for conducting air led into said shroud, wherein said plurality of cooling holes and said plurality of cooling passages are each divided into two groups; and two cavities formed in said shroud, each of said two cavities connecting to one of said groups of cooling holes of said blade and one of said groups of cooling passages of said shroud;

wherein said groups of said cooling passages of said shroud are arranged such that cooling air flowing therethrough flows out of mutually opposing side portions of said shroud.

5. A gas turbine moving blade comprising:

a blade having a terminal end, a base portion, an end portion side and a base portion side;

a shroud at said terminal end of said blade, said shroud having a peripheral portion; and a cooling passage extending in said blade from said base portion to said terminal end and leading cooling air into said shroud, the cooing air flowing out of said shroud through said peripheral portion;

wherein said cooling passage is formed by a cavity extending in said blade having therein a plurality of pin fins on said base portion side of said blade and a plurality of slender holes extending in said blade toward said terminal end thereof on said end portion side of said blade; and wherein a length of said slender holes on said end portion side of said blade is ½ or less of an entire length of said blade.

6. The gas turbine moving blade of claim 5, wherein:

said shroud comprises a plurality of cooling holes each connecting to one of said slender holes of said blade; and said plurality of cooling holes are arranged to alternate directions for the flow of cooling air therethrough between mutually opposing side portions of said shroud.

* * * * *